United States Patent [19]

Wawrzynowski et al.

[11] Patent Number: 4,884,643

[45] Date of Patent: Dec. 5, 1989

[54] DOWNHOLE ADJUSTABLE BENT SUB

[75] Inventors: Mike Wawrzynowski; Don Ruckman, both of Edmonton, Canada

[73] Assignee: 392534 Alberta Ltd., Edmonton, Canada

[21] Appl. No.: 297,360

[22] Filed: Jan. 17, 1989

[51] Int. Cl.[4] ..... E21B 7/08; E21B 7/10

[52] U.S. Cl. ..... 175/74; 166/237; 175/75; 175/322; 175/325

[58] Field of Search ..... 166/237; 175/74, 75, 175/61, 320, 321, 322, 45

[56] References Cited

U.S. PATENT DOCUMENTS

| | | | |
|---|---|---|---|
| 3,586,116 | 6/1971 | Tiraspolsky et al. | 175/74 |
| 3,811,519 | 5/1974 | Driver | 175/73 |
| 4,067,404 | 6/1978 | Crase | 175/75 |
| 4,077,657 | 3/1978 | Trzeciak | 285/184 |
| 4,220,214 | 9/1980 | Benoit | 175/61 |
| 4,240,512 | 12/1980 | Haglund | 175/75 |
| 4,286,676 | 9/1981 | Nguyen et al. | 175/74 |
| 4,303,135 | 12/1981 | Benoit | 175/73 |
| 4,343,369 | 8/1982 | Lyons et al. | 175/75 |
| 4,596,294 | 6/1986 | Russell | 175/74 |
| 4,629,012 | 12/1986 | Schuh | 175/75 |
| 4,641,717 | 2/1987 | Eppink | 175/74 |
| 4,739,842 | 4/1988 | Kruger et al. | 175/75 X |
| 4,745,982 | 5/1988 | Wenzel | 175/74 |

*Primary Examiner*—Stephen J. Novosad

[57] ABSTRACT

A downhole adjustable bent sub is provided for use in a drilling process in which a drill bit is subjected to a drilling force. The bent sub has a tubular housing and a tubular mandrel. The tubular housing has a bend along its length to define an upper part and a lower part, the respective longitudinal axes of which intersect at an angle. The tubular mandrel also has a bend along its length to define a first part and a second part, the respective longitudinal axis of which intersect at an angle. The first part of the mandrel slidably engages the interior of the lower part of the tubular housing. a longitudinal stop prevents the mandrel from being slid out of the housing. Longitudinal biasing means urge the mandrel toward the longitudinal stop to a first position. A rotational stop prevents relative rotation between the mandrel and the housing when the mandrel is in the first position. The rotational stop allows relative rotation between the mandrel and the housing when the mandrel is slid into the housing to a second position away from the longitudinal stop. A rotator acts between the mandrel and the housing. The rotator rotates the mandrel, relative to the housing, a predetermined amount when the mandrel is slid from the first position to the second position and returned to the first position.

8 Claims, 4 Drawing Sheets

DOWNHOLE ADJUSTABLE BENT SUB

FIELD OF THE INVENTION

This invention relates to geological drilling and more particularly relates to directional drilling. Even more particularly the present invention relates to the use of "subs" in directional drilling.

BACKGROUND OF THE INVENTION

In various drilling situations it is desirable to drill at an angle from the vertical. Such situations include drilling inaccessible locations (such as under rivers or other bodies of water when the drilling begins on land), drilling around obstructions which prevent a substantially vertical well direction and, the use of drain holes in which the bore hole penetrates substantially horizontally through a relatively thin subterranean stratum to drain the fluids therefrom more effectively than would be possible with a vertical bore hole.

In drilling, a "sub" is a short threaded piece of drill pipe generally used to connect parts of the drill string which cannot otherwise be screwed together because of difference in thread size or design. One manner of achieving directional drilling is to insert, at the downhole end of a drill string, a sub which has been "bent" such that the longitudinal axis at one of its ends is at a slight angle, referred to herein as "offset angle", to the longitudinal axis at the other of its ends. Such a tool is called a "bent sub". To vary a bore hole away from the vertical axis, the drill string is withdrawn and a bent sub having the desired offset angle is inserted between the end of the drill string and the downhole motor. The drill string is then reinserted into the hole and, as the longitudinal axis of the drill bit will now be at an angle to the original bore hole, the direction of the bore hole will be altered. The bent sub may be replaced any number of times in order to provide a bore hole of the desired shape.

It will be appreciated that the more remote the bent sub is from the drill bit, the lesser will be the maximum offset angle before the drill string will scrape against a bore hole. One method of moving the bent sub as close as possible to the drill bit, and hence maximizing the allowable offset angle, is to position the bent sub between the power unit and bearing components of the downhole motor.

A disadvantage with using a bent sub as described above is that to make any angle corrections while drilling is in process, it is necessary to raise the complete drill column out of the drill hole, disassemble the drill column, remove the sub, replace the sub with one having a different offset angle, and reinsert the drill column into the drill hole. To reduce the down time in such a process, various adjustable bent subs such as that described in U.S. Pat. No. 4,745,982 issued to Wenzel have been developed. While these subs eliminate the down time attributable to disassembling the drill column, they still incur the down time associated with removal and installation of the drill column from the drill hole.

To reduce this latter down time, various adjustable bent subs have been developed which are "downhole adjustable" in that they can be adjusted without removal of the drill column from the drill hole. Examples of such downhole adjustable bent subs include U.S. Pat. Nos. 4,286,676, 4,596,294 and 3,811,519 which issued to Nguyen et al., Russell, and Driver respectively. Nguyen and Russell teach the use of subs having at least one swivelable angled joint. Relative rotation of the parts of the sub on either side of the angled joint used in Nguyen and Russell causes the offset angle to vary. Both Nguyen and Russell have rotating mechanisms inside of the sub which react to drilling mud pressure to effect the rotation. Driver teaches the use of a plurality of radially disposed hydraulic cylinders to bend a flexible section of the drive shaft connecting the downhole motor and the drill bit.

A disadvantage with Nguyen is that to effect rotation, either electrical connection must be made down the drill string to the adjustable sub, or spheres must be pumped down to the sub through the drill string. Both of these variations of Nguyen interfere with the flow of drilling mud through the drill column.

The device in Russell is actuated by successive increases and decreases of internal drill string pressure. This device relies on a combination of gas and spring pressure to control a rather complicated spherical valve which in turn activates the rotating mechanism. The complexity of this device gives rise to many possible sources of failure.

Driver requires that hydraulic lines be extended to the hydraulic cylinders. This would interfere with the flow of drilling mud, make the connection of adjacent sections of drill string more time consuming and give rise to sources of possible failure.

SUMMARY OF THE INVENTION

According to the present invention there is provided a downhole adjustable bent sub for use in a drilling process having a drill bit subjected to a drilling force. The drilling sub has a tubular housing with an upper part and a lower part. The upper part has an upper longitudinal axis and the lower part has a lower longitudinal axis. The upper and lower parts are joined at a first bend with the upper and lower longitudinal axes intersecting at an angle. The upper part has a top end distal the first bend. The downhole adjustable bent sub further has a tubular mandrel with a first part and a second part. The first part has a first longitudinal axis and the second part has a second longitudinal axis. The first and second parts are joined at a second bend with the first and second longitudinal axes intersecting at an angle. The first part of the mandrel has a first end distal the second bend. The first part of the mandrel toward the first end is disposed within the lower part of the housing and is longitudinally slidable therein.

A longitudinal stop is provided to limit displacement of the mandrel away from the top of the housing. Longitudinal biasing means urge the mandrel away from the top of the housing toward a first position where the longitudinal stop prevents further displacement of the mandrel away from the housing.

The mandrel has a second position in which it is displaced toward the top of the housing. A rotational stop prevents relative rotation between the first part of the mandrel and the lower part of the housing when the mandrel is in the first position. The rotational stop allows relative rotation between the mandrel and the lower part of the housing when the mandrel is in the second position.

The downhole adjustable bent sub further has a rotator which acts between the mandrel and the housing. The rotator reacts to longitudinal displacement between the mandrel and the housing to cause a predetermined amount of relative rotation between the first part of the mandrel and the housing when the mandrel is displaced from the first positon to the second position and returned to the first position.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF THE PREFERRED EMBODIMENT

Figure 1:
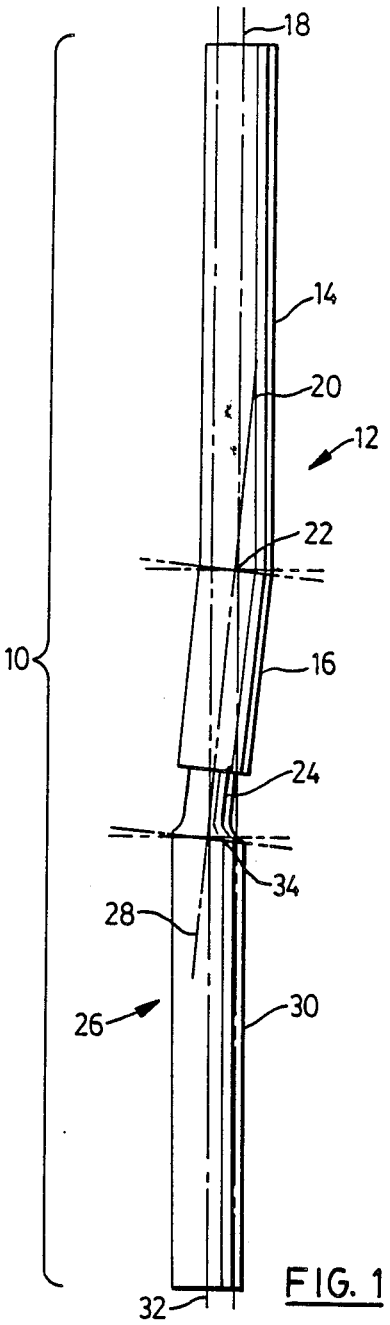
FIG. 1 shows an outline of the downhole adjustable bent sub according to the present invention in the position for vertical drilling.

Referring to FIG. 1 the downhole adjustable bent sub is generally identified by reference 10. The sub 10 has a tubular housing generally indicated by reference 12. The housing has an upper part 14 and a lower part 16. The upper part 14 of the housing 12 has an upper longitudinal axis 18 and a lower longitudinal axis 20. The upper and lower parts, 14 and 16 respectively, of the tubular housing 12, join at a first bend 22. The upper and lower longitudinal axes, 18 and 20 respectively, intersect at an angle in the first bend 22.

Inserted into the lower part 16 of the housing 12 is a first part 24 of a tubular mandrel 26. The first part 24 of the mandrel 26 has a first longitudinal axis 28 which is coincident with the lower longitudinal axis 20 of the lower part 16 of the housing 12. The mandrel 26 further has a second part 30 having a second longitudinal axis 32. The first and second parts, 24 and 30 respectively, of the mandrel 26, join at a second bend 34. The first and second longitudinal axes, 28 and 32 respectively, of the mandrel 26, intersect at an angle at the second bend 34.

The first part 24 of the mandrel 26 is longitudinally slidable within the lower part 16 of the housing 12. The adjustable bent sub 10 is provided with a rotator which will be described in more detail below. The rotator causes the first part of the mandrel 24 to rotate within the lower part 16 of the housing 12. This rotation is about a common axis coincident with the lower longitudinal axis 20 of the lower part 16 of the housing 12 and the first longitudinal axis 28 of the first part 24 of the mandrel 26. The upper longitudinal axis 18 of the housing 12 intersects this common axis at the first bend 22. The second longitudinal axis 32 of the second part 30 of the mandrel 26 intersects the common axis at an angle at the second bend 34. It will be appreciated therefore that as the first part 24 of the mandrel 26 is rotated within the lower part 16 of the housing 12, the angular relationship between the upper part 14 of the housing 12 and the second part 30 of the mandrel 26 will vary. This can be seen by referring to FIGS. 1 and 2 in which the mandrel and the housing are shown rotated 180° relative to each other.

Figure 2:
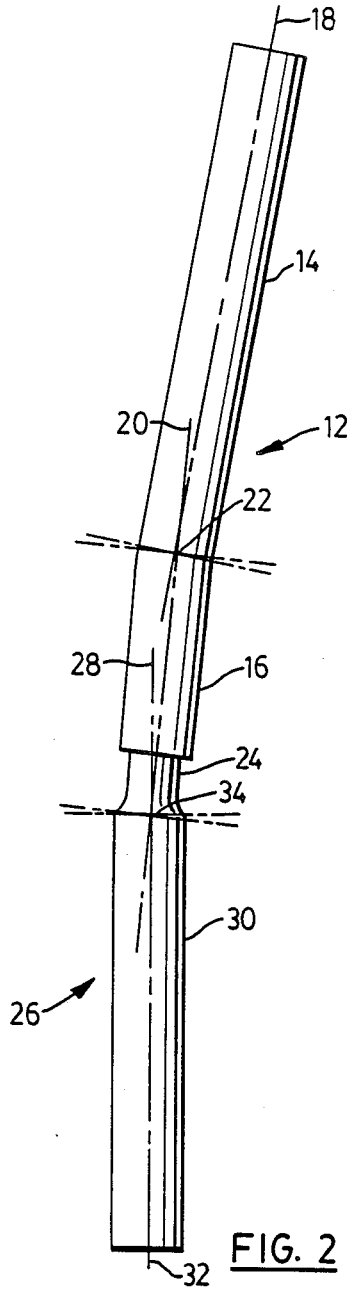
FIG. 2 an outline of a downhole adjustable bent sub according to the present invention in a position for directional drilling.

The offset angles of the first and second bends, 22 and 34 respectively, in FIGS. 1 and 2 are shown as both being the same. In FIG. 1 the offset angles cancel each other and accordingly the upper longitudinal axis 18 of the upper part 14 of the housing 12 is parallel to the second longitudinal axis 32 of the second part 30 of the mandrel 26. In FIG. 2 these angles are additive and the angle defined between the upper longitudinal axis 18 and the second longitudinal axis 32 would be twice the offset angle. As the mandrel 26 and housing 12 are rotated relative to each other, the upper longitudinal axis 18 and the second longitudinal axis 32 would vary from being parallel, as in FIG. 1, to a maximum angle of intersection upon 180° of relative rotation, as shown in FIG. 2. Further rotation would cause the angle between the upper longitudinal axis 18 and the second longitudinal axis 32 to decrease until these axes were once again parallel at 360° of relative rotation.

Any desired offset angle can be used. It is not necessary for the offset angles of the first and second bends, 22 and 34 respectively, to be the same. If the offset angles however are not the same, it will not be possible to use the adjustable bent sub 10 for drilling in a vertical direction. The offset angles would typically be in the order of 1° to 2°.

Figure 3:
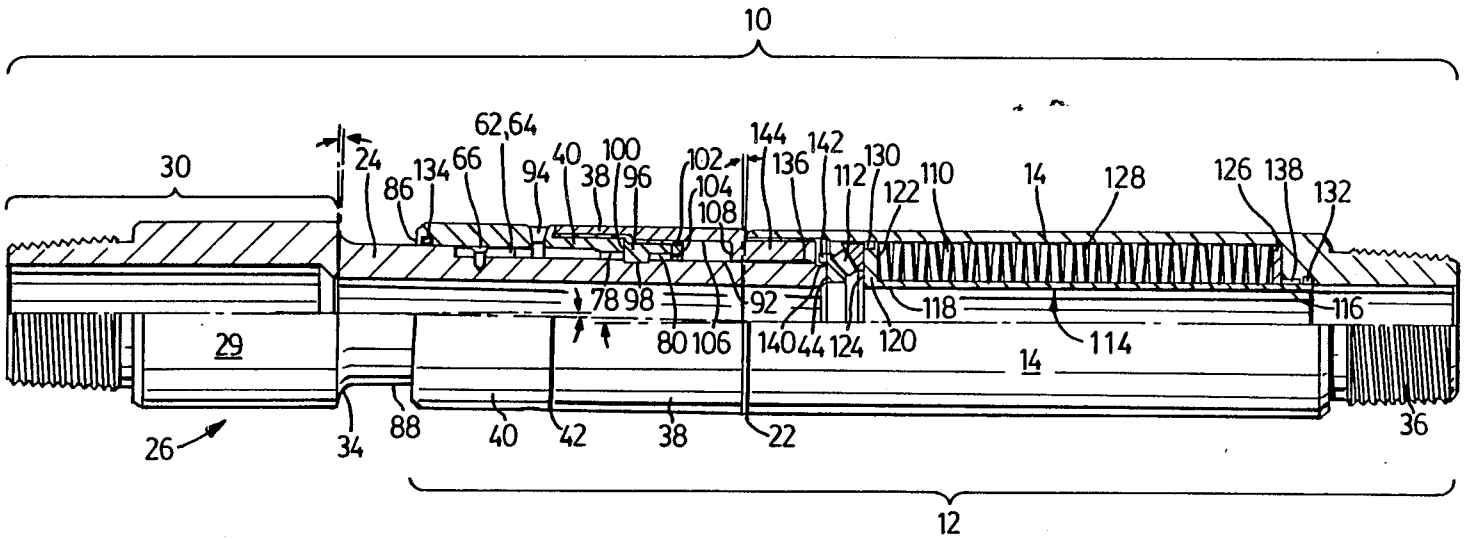
FIG. 3 is a partial sectional view of a downhole adjustable bent sub according to the present invention.
Figure 4:
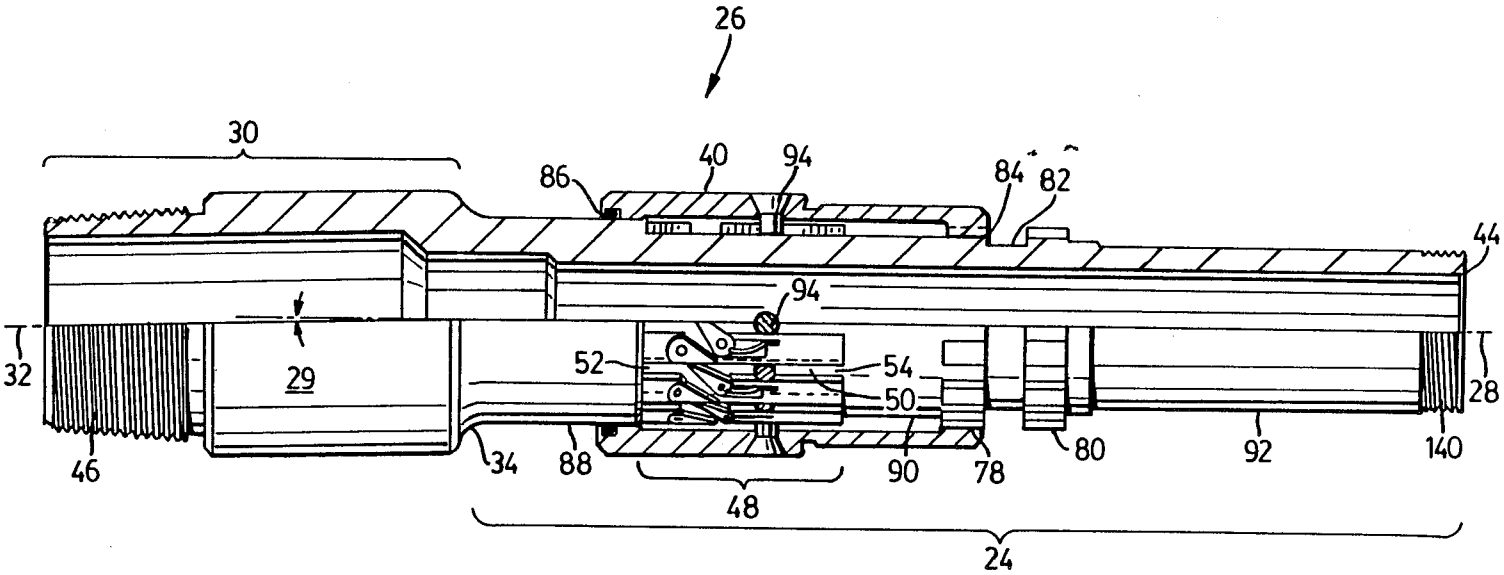
FIG. 4 is a partial sectional view of the mandrel portion of a downhole adjustable bent sub according to the present invention.

Referring to FIGS. 3 and 4, the operation and structure of the mandrel will now be described in more detail. The upper part 14 of housing 12 has a top 36 distal the first bend 22. The top 36 is provided with threads which match that part of the drill column to which it is desired to attach the downhole adjustable bent sub. The top 36 would typically be attached to the rotor and stator of the downhole motor.

The lower part 16 of the housing 12 is shown in FIG. 3 as comprising a stopper 38 and a drive housing 40. The stopper 38 and drive housing 40 are threadedly connected at joint 42. The stopper 38 and drive housing 40 are coaxial. The stopper 38 is threadedly connected to the upper part 14 or the housing 12 at the first bend 22. The offset angle between the upper and lower parts, 14 and 16 respectively, of the housing 12 can be achieved by machining the threaded portions of the stopper 38 and the upper part 14 of the housing 12 adjacent the first bend 22 appropriately.

Referring to FIGS. 3 and 4, the first part 24 of the mandrel 26 has a first end 44 distal the second bend 34. The opposite end 46 of the mandrel 26 is provided with threads suitable for attachment to the portion of the drill string below the downhole adjustable bent sub 10. This would typically be the bearing housing of the downhole motor. The mandrel is shown as being of unitary construction. The bend 34 in such a unitary construction can be achieved either in the machining of the mandrel or by bending the first part 24 of the mandrel 26 relative to the second part 30 to the desired offset angle at the second bend 34.

Figure 5:
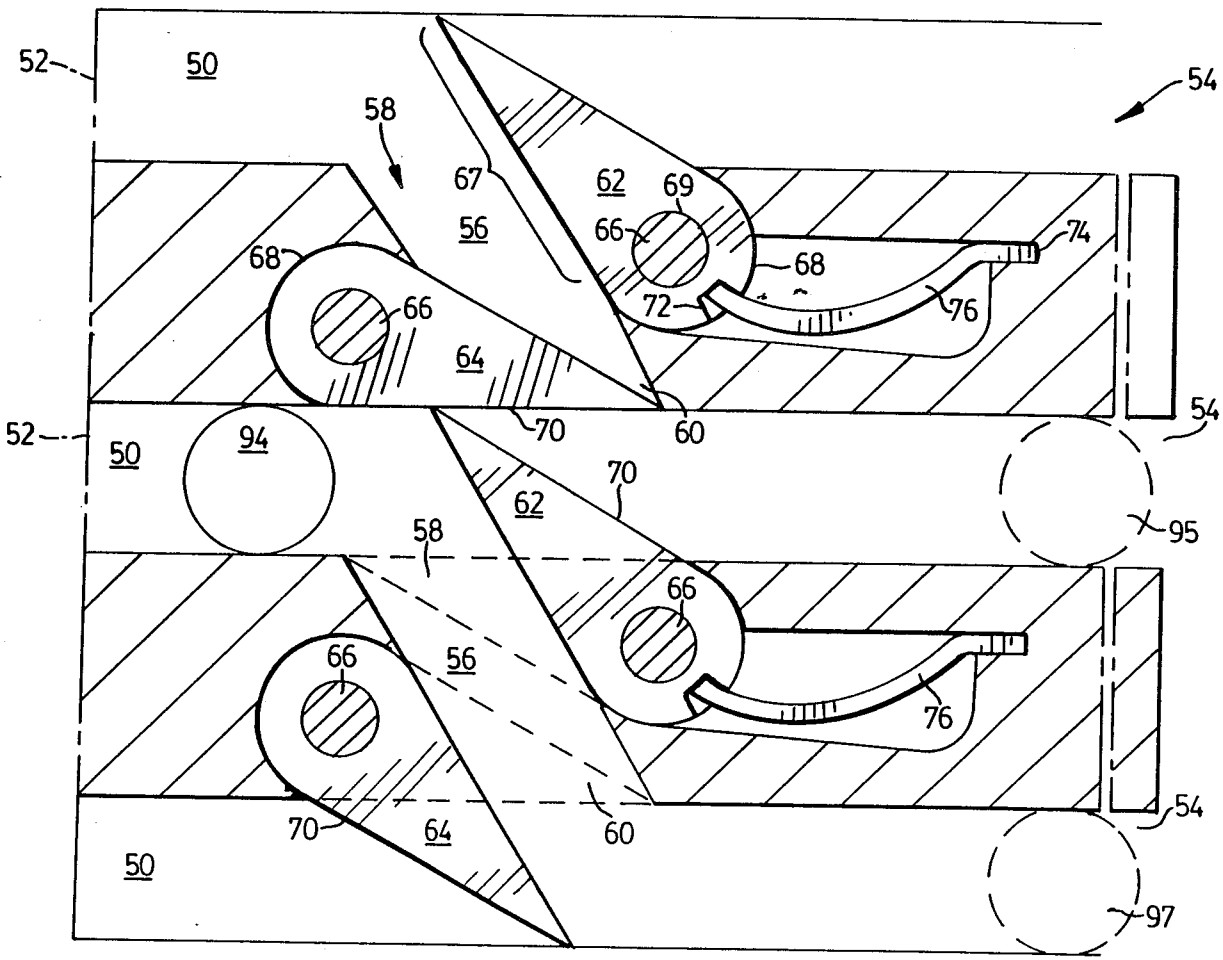
FIG. 5 is an enlarged plan view showing a rotator for a downhole adjustable bent sub according to the present invention.

The first part of the mandrel 24 is provided with a series of channels and gates about its circumference at 48. FIG. 5 shows a few of these channels and gates in more detail. Several longitudinal channels 50 are provided about the circumference of the first part 24 of the mandrel 26. The longitudinal channels 50 are parallel to the first longitudinal axis 28 of the mandrel 26. The longitudinal channels 50 are substantially evenly radially spaced about the circumference of the mandrel 26. The longitudinal channels have a front end 52 opposite a back end 54. Adjacent longitudinal channels are joined by crossover channels 56. The crossover channels 56 are generally parallel to each other and have an upper end 58 opening into a longitudinal channel 50 toward the front end 52 of the longitudinal channel 50. The crossover channels have a lower end 60 opening into an adjacent one of the longitudinal channels 50, toward the back end 54 of the longitudinal channel 50.

The crossover channels 56 are provided with an upper gate 62 at their upper ends 58. The crossover channels are provided with lower gates 64 at their lower ends 60. The gates as shown have a rounded pivotal end 68 from which projects a V shaped portion 67. The point of the V shaped portion faces away from the rounded end. The rounded end is provided with a cylindrical pivot hole 69 therethrough. The upper and lower gates 62 and 64 respectively, are pivotally mounted on pivot pins 66 adjacent respective pivotal ends 68 of the gates. The pivotal mounting is achieved by placing the pivot holes 69 over the pivot pins 66. The upper and lower gates 62 and 64 respectively, each have a bearing side 70 facing the longitudinal channel 50 adjacent which they are mounted.

Referring to the lower half of FIG. 5, the upper gate 62 has a closed position shown in solid outline and an open position shown in dashed lines. In the closed position the upper gate extends across the longitudinal channel 50. To reach the open position, the upper gate is rotated anti-clockwise about pivot pin 66 to lie across the upper end 58 of crossover channel 56. A curved spring 76 extends between a notch 74 in the mandrel 26 and a notch 72 in the pivotal end 68 of the upper gates 62. The spring 76 acts as a gate biasing means to urge the upper gates 62 toward their respective closed positions.

Still referring to the lower half of FIG. 5, the lower gate 64 has a closed position shown in dashed outline and an open position shown in solid lines. In the closed position the lower gate extends across the lower end 60 of the crossover channel 56. In the open position the lower gate 64 extends across the adjacent longitudinal channel 50. The lower gates are rotatable anti-clockwise from their respective open positions to their closed positions.

Referring to the upper and lower gates, 62 and 64 respectively, adjacent the middle longitudinal channel 50 in FIG. 5, it will be appreciated that as the spring 76 rotates the upper gate 62 clockwise, the bearing side 70 of the upper gate 62 will bear against the bearing side 70 of the lower gate 64 above it. In this manner, as the upper gate 62 is urged toward its closed position it will in turn urge lower gate 64 to its respective closed position. In this manner the springs 76 acts as gate biasing means urging the upper and lower gates toward their respective closed positions. While separate springs could be provided for the lower gate 64, the arrangement shown is simpler in that it reduces the number of components.

Referring to FIGS. 3 and 4, the first part 24 of the mandrel 26 is provided with splines 78 between the sliders and gates at 48 and the first end 44. The mandrel 26 has a second matching set of splines 80, parallel to the splines 78 and separated therefrom by a groove 82. Groove 82 extends around the circumference of the mandrel 26.

The mandrel 26 has a first sliding surface 88 adjacent the second bend 34, a second sliding surface 90 between the channels and gates at 48 and the splines 78 and, a third sliding surface 92 between the second set of splines 80 and the first end 44.

The drive housing 40 is mountable over the first part 24 of the mandrel 26. The drive housing 40 is provided with internal splines 84 at one end which engage the splines 78 of mandrel 26. The drive housing 40 has a downhole end 86 distal the internal splines 84. The downhole end 86 is slidablc along the first sliding surface 88. The ends of the internal splines 84 are slidable along the second sliding surface 90.

The drive housing 40 further has a cylindrical slider 94 projecting toward the mandrel. The slider 94 engages and is slidable along longitudinal channels 50 and through crossover channels 56. FIG. 4 shows a slider 94 in each longitudinal channel. Only one slider need be provided to cause the mandrel 26 to rotate in respect to the drive housing 40. This will become apparent below where the rotation is more fully described.

FIGS. 3 and 4 show the relationship between the mandrel 26 and the drive housing 40 in a first position. In this first position, the internal splines 84 of drive housing 40 engage splines 78 on the first part 24 of the mandrel 26. In this first position the splines 78 on the mandrel 26 and the internal splines 84 of the drive housing 40 act together as a rotational stop to prevent relative rotation between the drive housing and the mandrel 26. The drive housing 40, stopper 38 and upper end 14 of the housing 12 are also rotationally rigid in this first position because of the threaded connections at the joint 42 and the first bend 22. It will be appreciated therefore that in the first position the mandrel 26 is rotationally rigid relative to housing 12.

The mandrel 26 is prevented from being withdrawn from the housing 12 by split ring 96 shown in FIG. 3. Split ring 96, which is not shown in detail, is an annular ring with an inwardly projecting lip 98 which engages groove 82. Split ring 96 would typically be segmented, at least diametrically, for mounting over the mandrel 26. The engagement between the inwardly projecting lip 98 of the split ring 96 and groove 82 limits longitudinal movement of the split ring 96 along the first part 24 of the mandrel 26. The split ring 96 has a face 100 which abuts the drive housing 40 adjacent the ends of the internal splines 84 distal the downhole end of the drive housing 40. The splines form an inwardly projecting ridge in the lower part 16 of housing 12. The split ring 96 abuts this ridge to act as a longitudinal stop to limit movement of the mandrel 26 away from the top 36 of housing 12. The second set of splines on the mandrel 26 act as a shoulder beneath the inwardly projecting lip 98 of the split ring 96 to improve the strength of this assembly. The reason splines are used rather than an unbroken circumferential collar is to permit the drive housing 40 to be slid along the first part 24 of mandrel 26 during assembly.

The stopper 38 is tubular and has a generally cylindrical interior. The internal diameter of the stopper 38 is larger toward the drive housing 40 than it is toward the upper part 14 of housing 12. The change in diameter occurs at a step 108. The stopper 38 has an interior surface 106 inside its larger diameter portion.

The split ring 96 rests in a cup shaped seal housing 100. The seal housing 100 extends between the third sliding surface 92 of the mandrel 26 and the interior surface 106 of the stopper 38. The seal housing is provided with an outer seal 102 between the seal housing and the inner surface 106 of the stopper 38. The seal housing 100 is provided with an inner seal 104 between the seal housing 100 and the third sliding surface 92 of the mandrel 26. The purpose for these seals is more fully described below.

The mandrel 26 is telescopically or longitudinally slidable toward the top end 36 of housing 12. The mandrel is limited in displacement toward the top end 36 of the housing 12 by abutment of the seal housing 102 against the step 108. The mandrel 26 can also be provided with an enlarged diameter portion 29 adjacent the second bend 34. The enlarged diameter portion 29 would abut the housing 12 as the mandrel is slid into the housing, thus limiting displacement of the mandrel 26 toward the top end 36 of the housing 12.

As the stopper 38 prevents longitudinal movement of the drive housing 40 toward the upper part 14 of the housing 12, it will be appreciated that movement of the mandrel 26 toward the top 36 of the housing 12 will cause the splines 78 on mandrel 26 to disengage from the internal splines 84 of the drive housing 40. When the splines are disengaged, the sliders 94 are all that control the rotational relationship between the mandrel 26 and the housing 12.

Referring to FIG. 5 the rotation of the mandrel 26 relative to the housing 12 will now be described. In the first position described above, the slider 94 would be at the right hand side of the centre longitudinal channel 50. This is shown in dashed outline at 95. Movement of the mandrel toward the top 36 of the housing 12 would cause relative motion between the slider 94 and the longitudinal channel 50 toward the front end 52 of the longitudinal channel 50. This movement would cause slider 94 to bear against bearing surface 70 of the upper gate 62 in turn causing the upper gate 62 to pivot to its open position shown in dotted outline in FIG. 5. Once the slider 94 has passed the upper gate 62, the spring 76 will return the upper gate 62 to its closed position shown in solid outline. Once the slider 94 has passed the upper gate 62 to the position shown in solid outline in FIG. 5, the mandrel can be said to be in a second position. The relative longitudinal movement between the mandrel 26 and housing 12 from the first position to the second position will, as described above, cause the splines 78 and 84 to disengage. As the mandrel is returned to the first position the slider 94 is prevented from sliding from the front end 52 of the longitudinal channel 50 in which it is disposed to the back end 54 of that same channel by the upper gate 62, which is in its closed position. The slider 94 will therefore be deflected by the upper gate 62 into the upper end 58 of the crossover channel 56. Further movement of the mandrel 26 away from the top end 36 of the housing 12 will cause the slider 94 to slide through the crossover channel 56 until it engages the lower gate 64 which will be in its closed position as shown in dashed outline. Continued movement of the slider will pivot the lower gate 64 clockwise as illustrated in FIG. 5 to its open position shown in solid lines. As the mandrel 26 is further urged towards its first position the slider 94 will slide through the lower end 60 of the crossover channel 56 and into the adjacent longitudinal channel 50, below the centre longitudinal channel 50, and toward the back end 54 of that longitudinal channel. This position of the slider is shown in dashed outline at 97. As the slider 94 slides from the lower end 60 of the crossover channel 56 toward the back end 54 of the longitudinal channel 50, the splines 78 and 84 will re-engage and the mandrel will return to its first position.

The slider 94 is rigid with drive housing 40 which forms part of the housing 12 and is rotationally and longitudinally rigid therewith. The gates and sliders are shown as forming part of the mandrel 12. The longitudinal gates 50 and crossover gates 56 are longitudinally and rotationally rigid relative to the mandrel 26. It will therefore be appreciated that the movement of the slider 94 through the channels 50 and 56 will cause the second part 30 of the mandrel 26 to rotate relative to the lower part 16 of the housing 12.

The gates and channels have been shown and described as forming part of the mandrel 26 and the slider as forming part of the housing 12. It would, of course, be possible to reverse this relationship. Other systems of sliders and channels could also be used. For example, the slider could be radially moveable relative to the mandrel toward or away from the bottom of the channels, and provided with biasing means to urge it toward the channels. In this latter arrangement the channels could be provided with a series of ridges, with ramps leading up to these ridges, o control the movement of the slider through the channels.

Referring to FIG. 3 the first end 44 of the mandrel 26 rests against one face of a bearing 112. Adjacent bearing 112 is a tubular wash pipe 114. The tubular wash pipe 114 has a housing end 116 longitudinally slidable through the top 36 of housing 12. The wash pipe further has a mandrel end 118 toward the first end 44 of the mandrel 26. The wash pipe is provided with an annular collar 120 adjacent the mandrel end 118. The collar 120 has a top side 122 facing toward the top 36 of the housing 12. The collar 120 of the wash pipe 114 further has a bottom side 124 facing toward the first end 44 of the mandrel 26. The bottom side 124 rests against the opposite face of bearing 112 from that on which the first end of the mandrel 44 rests.

The upper part 14 of the housing 12 is provided with a reduced diameter portion adjacent the top 36. An annular cavity 128 is therefore defined between the wash pipe and the interior of the upper part 14 of the housing 12. A return spring 110 occupies the annular cavity 128. One end of the return spring acts against the top side 122 of the collar 120 of the wash pipe 114. The opposite end of the return spring 110 bears against a disc shaped rest ring 126 adjacent the reduced diameter portion of the upper part 14 of housing 12. The return spring 110 bears against the top side 122 of the collar 120 urging the mandrel end of the wash pipe 114 toward the first end 44 of the mandrel 26. Collar 120 in turn urges bearing 112 to slide toward the first end 44 of the mandrel 26. In this manner return spring 110 acts as a biasing means urging the mandrel 26 toward its first position. The annular cavity 128 would typically contain oil for lubrication of the return spring 110.

Bearing 112 permits the return spring 110 to exert pressure against the first end 44 of the mandrel 26 while permitting the mandrel to be rotated as described above. It is preferable that the bearing 112 be a spherical bearing to permit the portion of the bearing adjacent the mandrel to tilt relative to that portion of the bearing adjacent the collar 120. In this manner the first end 44 of the mandrel 26 can be disposed within the upper part 14 of the housing 12 with the bearing 112 tilting to accommodate the offset between the first part 24 of mandrel 26 and the upper part 14 of housing 12. Disposing the first end 44 of the mandrel 26 within the upper part 14 of housing 12 allows for a shorter adjustable bent sub 10. A shorter sub is desirable because it maximizes the amount of offset obtainable before the drill string components bind against the bore hole.

In a typical drilling operation, the nominal weight on a drill bit during drilling is 3,500 to 6,500 pounds per inch of bit diameter (or 60 to 115 daN/mm of bit diameter). Return spring 110 would be selected to exert a force above this weight. In this manner, in normal drilling, the mandrel 26 and the housing 12 maintain a fixed rotational and longitudinal relationship. To vary the angle of drilling, a force which is greater than that exerted by the return spring is applied along the drill string. This latter applied force acts against the resiliency of the return spring 110 to cause the mandrel 26 to move from its first position to its second position. Subsequent removal of the load applied along the drill string permits the return spring 110 to restore the mandrel 26 to its first position. The movement of the mandrel from its first position to its second position and back to its first position would cause the mandrel 26 to rotate relative to the housing 12, as described above, to vary the drilling angle. Each cycle of loading and unloading would cause a predetermined amount of rotation. The amount of rotation is determined by the spacing between the longitudinal channels 50.

As a pressurized flow of drilling mud passes through the adjustable bent sub 10 during drilling, it is desirable to provide seals in the sub 10 to prevent the entry of dirt between the moveable portions, where the dirt would promote wear. It is further desirable to provide seals in the sub 10 to prevent the leakage of drilling mud from the sub 10. Various seal locations are shown in FIG. 3. Various types of seals for these purposes are generally commercially available and their selection would be a matter of preference for one skilled in the art. Collar seal 130 seals between the interior of the upper part 14 of the tubular housing 12 and the collar 120 of the wash pipe 114. A housing end seal 132 is provided between the housing end 116 of the wash pipe 114 and the interior of the top 36 of housing 12. A downhole end seal 134 is provided between the downhole end of drive housing 40 and the first sliding surface 88.

A first end guide sleeve 136 is located between the narrowed portion of the stopper 38 and the third sliding surface 92 of the mandrel 26. A top guide sleeve 138 separates the housing end 116 of the wash pipe 114 and the interior of the top 36 of housing 12. The first end guide sleeve 136 provides a bearing surface between the third sliding surface 92 of the mandrel and the narrowed portion of the stopper 38. The top guide sleeve 138 provides a bearing surface between the housing end 116 of the wash pipe 114 and the interior of the top 36 of housing 12. The sleeves 136 and 138 would typically be made of a wear resistant material slightly softer than the components between which they are inserted. A suitable material is sintered bronze. In this manner the wear associated with relative movement, between the components on opposite sides of the sleeves, will be restricted to the sleeves. The sleeves can be replaced when they are worn which is more desirable than having to build up and re-machine worn surfaces on the mandrel 26, housing 12 or wash pipe 114.

The first part 24 of the mandrel 26 is provided with external threads 140 adjacent the first end 44. The threads 140 receive safety nut 142 shown in FIG. 3. The safety nut 142 is adjacent the externally threaded end 144 of the stopper 38 when the mandrel 26 is in its first position. The safety nut acts as a supplementary longitudinal stop to prevent withdrawal of the mandrel 26 from the housing 12 should the longitudinal stop provided by split ring 96 fail.

It is to be understood that what has been described above are preferred embodiments of the present invention. It would be obvious to one skilled in the art that many variations can be made to the structure, arrangements, proportions etc. described above, particularly in adapting the above invention for specific operating environment and requirements, without departing from the spirit and scope of the present invention.

We claim:

1. A downhole adjustable bent sub for use in a drilling process having a drill bit subject to a drilling force, said downhole adjustable bent sub comprising:

a tubular housing having an upper part and a lower part, said upper part having an upper longitudinal axis, said lower part having a lower longitudinal axis, said upper and lower parts being joined at a first bend with said upper and lower longitudinal axes intersecting at an angle, said upper part of said housing having a top end distal said first bend;

a tubular mandrel having a first part and a second part, said first part having a first longitudinal axis and said second part having a second longitudinal axis, said first and second parts being joined at a second bend with said first and second longitudinal axes intersecting at an angle, said first part of said mandrel having a first end distal said bend, said first part of said mandrel adjacent said first end being disposed within said lower part of said housing and longitudinally slidable therein;

a longitudinal stop limiting displacement of said mandrel away from said top of said housing; longitudinal biasing means urging said mandrel away from said top of said housing toward a first position where said longitudinal stop prevents further displacement of said mandrel away from said top of said housing; said mandrel having a second position in which said mandrel is displaced toward said top of said housing;

a rotational stop preventing relative rotation between said first part of said mandrel and said lower part of said housing when said mandrel is in said first position, and allowing such relative rotation when said mandrel is in said second position; and, a rotator acting between said mandrel and said housing, said rotator reacting to longitudinal displacement between said mandrel and said housing to cause a predetermined amount of relative rotation between said first part of said mandrel and said lower part of said housing when said mandrel is displaced from said first position to said second position and returned to said first position.

2. A downhole adjustable bent sub as in claim 1 wherein;

said first part of said mandrel and said lower part of said bearing housing are generally concentric about a common axis coincident with said lower longitudinal axis of said housing and said first axis of said mandrel; and, said rotator further comprises;

a plurality of generally parallel sided depressions defining at least two adjacent longitudinal channels and at least one crossover channel, said longitudinal channels being approximately parallel to each other and to said common axis and, said longitudinal channels having a front end opposite a back end, said crossover channel generally diagonally connecting adjacent of said longitudinal channels and having an upper end opening into one of said longitudinal channels toward said front end of said longitudinal channel and a lower end opening into an adjacent one of said longitudinal channels toward said back end of said longitudinal channel;

at least one slider, said slider being slidable along said channels;

direction controllers guiding said slider along one of said longitudinal channels when said slider is slid in one direction along said longitudinal channel, and guiding said slider into said crossover channel and into said adjacent longitudinal channel when said slider is slid in the opposite direction;

said slider being affixed to one of said lower part of said housing and said first part of said mandrel; and, said direction controllers and said longitudinal and crossover channels being affixed to the other of said lower part of said housing and said first part of said mandrel.

3. A downhole adjustable bent sub as in claim 2 wherein said direction controllers further comprise:

an upper gate pivotally mounted at said upper end of at least one of said crossover channels and a lower gate pivotally mounted at the lower end of said crossover channels, said upper and lower gates having respective closed postions, said upper gate in said closed position preventing sliding of said slider from said front end of said longitudinal channel adjacent said upper gate to said back end of said longitudinal channel adjacent said upper gate, said lower gate in said closed position preventing sliding of said slider from said back end of said longitudinal channel adjacent said lower gate into said crossover channel;

gate biasing means urging said upper and lower gates into said respective closed positions;

said upper gate being pivotal movable against said gate biasing means by said slider to permit said slider to be slid from said back end of said longitudinal channel adjacent said upper gate, past said upper gate; and, said lower gate being pivotally movable against said gate biasing means by said slider to permit said slider to be slid from said crossover channel, past said lower gate, into said longitudinal channel adjacent said lower gate.

4. A downhole adjustable bent sub as in claim 3 wherein;

each of said upper gates has a pivotal end toward which said upper gates are pivotally mounted;

each of said upper and lower gates has a bearing side facing that of said longitudinal channels adjacent which said upper and lower gates are respectively mounted; and, said gate biasing means has a resilient element acting against the pivotal end of each of said upper gates, said gate biasing means urging said bearing side of said upper gates toward said bearing side of said lower gates to bear against said bearing side of said lower gates thereby urging said lower gates toward their said closed positions.

5. A downhole adjustable bent sub as in claims 1, 2 or 3 wherein;

said upper end of said housing has a tubular wash pipe therein and generally coaxial therewith;

said wash pipe having a housing end slidable through said top of said housing;

a mandrel end toward said first end of said mandrel; and, a collar adjacent said mandrel end, said collar having a top side facing said top of said housing and a bottom side facing said first end of said mandrel;

said longitudinal biasing means are located between said wash pipe and said upper end of said housing and bear against said top side of said collar thereby urging said mandrel end of said wash pipe toward said first end of said mandrel; a tiltable bearing is interspersed between said bottom side of said collar and said first end of said mandrel, said tiltable bearing being longitudinally slidable within said upper part of said housing; and seals are provided between said wash pipe and said upper part of said housing and between said mandrel and said housing to fluidly isolate the interior of said wash pipe, and the interior of said mandrel from portions of the interior of said housing.

6. A downhole adjustable bent sub as in claims 1, 2 or 3 wherein said lower part of said housing and said first part of said mandrel are provided with matching splines, said splines on said lower part of said housing engaging said splines on said first part of said mandrel to act as said rotational stop.

7. A downhole adjustable bent sub as in claims 1, 2 or 3 wherein said lower part of said housing has a ridge projecting toward said first part of said mandrel and said mandrel has a split ring projecting toward said lower part of said housing, said split ring abutting said ridge when said mandrel is in said first position and acting as said longitudinal stop.

8. A downhole adjustable bent sub as in claim 4 wherein:

said lower part of said housing and said first part of said mandrel are provided with matching splines, said splines on said lower part of said housing engaging said splines on said first part of said mandrel to act as said rotational stop; said lower part of said housing has a ridge projecting toward said first part of said mandrel and said mandrel has a split ring projecting toward said lower part of said housing, said split ring abutting said ridge when said mandrel is in said first position and acting as said longitudinal stop;

said upper end of said housing has a tubular wash pipe therein and generally coaxial therewith;

said wash pipe having a housing end slidable through said top of said housing;

a mandrel end facing said first end of said mandrel; and, a collar adjacent said mandrel end, said collar having a top side facing said top of said housing and a bottom side facing said first end of said mandrel;

said longitudinal biasing means are located between said wash pipe and said upper end of said housing and bear against said top side of said collar thereby urging said mandrel end of said wash tube toward said first end of said mandrel; a tiltable bearing is interspersed between said bottom side of said collar and said first end of said mandrel, said tiltable bearing being longitudinally slidable within said upper part of said housing; seals are provided between said wash pipe and said upper part of said housing and between said mandrel and said housing to fluidly isolate the interior of said wash pipe and the interior of said mandrel from portions of the interior of said upper housing; and, said longitudinal biasing means is a spring exerting a force on said mandrel greater than said drilling force.

* * * * *